United States Patent [19]

Smith

[11] Patent Number: 4,668,195

[45] Date of Patent: May 26, 1987

[54] BOW MOTOR ASSEMBLY AND MOTOR LIFT MECHANISM

[76] Inventor: David N. Smith, 6575 LaBeau Ave. N.E., Albertville, Minn. 55301

[21] Appl. No.: 754,636

[22] Filed: Jul. 15, 1985

Related U.S. Application Data

[63] Continuation-in-part of Ser. No. 453,752, Dec. 27, 1982, Pat. No. 4,529,386.

[51] Int. Cl.[4] ..... B63H 5/12

[52] U.S. Cl. ..... 440/6; 440/54; 74/89.2

[58] Field of Search ..... 440/6, 53, 54, 62; 74/89.2, 89.21, 89.22; 248/640, 327, 328, 329, 332; 254/325, 327, 333, 334, 338, 371

[56] References Cited

U.S. PATENT DOCUMENTS

| | | | |
|---|---|---|---|
| 1,786,997 | 12/1930 | Harvey | 440/54 |
| 2,151,004 | 3/1939 | Barclay | 440/54 |
| 2,422,456 | 6/1947 | Wiseman | 254/103 |
| 2,570,534 | 10/1951 | Erny | 244/102 R |
| 2,885,990 | 5/1959 | Hawthorne | 440/54 |
| 3,587,512 | 6/1971 | Patterson | 440/54 |
| 3,685,481 | 8/1972 | Monsell | 440/54 |
| 3,807,347 | 4/1974 | Baldwin | 440/54 |
| 3,873,066 | 3/1975 | Opyrchal | 254/103 |
| 4,017,198 | 4/1977 | Mason | 403/43 |
| 4,226,206 | 10/1980 | Wilson | 440/62 |

OTHER PUBLICATIONS

Brochure-Minn Kota Motors-Minn Kota Motors, 1531 Madison Ave., Mankato, Minnesota 56001.

*Primary Examiner*—Peters, Jr. Joseph F.
*Assistant Examiner*—Edwin L. Swinehart
*Attorney, Agent, or Firm*—Burd, Bartz & Gutenkauf

[57] ABSTRACT

A boat is equipped with a motor assembly mounted on a housing in the bow of the boat. The housing has a compartment with a bottom opening accommodating a motor and propeller assembly. A mechanism is used to selectively move the motor and propeller assembly out of the compartment below the boat and retract the motor and propeller assembly back into the compartment. A pair of doors hinged to the bow and connected to the motor and propeller assembly are moved to closed positions when the motor and propeller assembly is located in the compartment and located in open positions when the motor and propeller assembly is moved to its down position below the boat.

43 Claims, 17 Drawing Figures

BOW MOTOR ASSEMBLY AND MOTOR LIFT MECHANISM

CROSS REFERENCE TO RELATED APPLICATION

This application is a continuation-in-part of U.S. application Ser. No. 453,752 filed Dec. 27, 1982, now U.S. Pat. No. 4,529,386.

SUMMARY OF THE INVNETION

The invention pertains to a boat and motor assembly wherein the motor shaft and propeller assembly of a boat motor extend and retract relative to the boat hull. The boat motor can be the primary or a secondary source of motive power for the boat. For example, fishermen frequently use boats having two outboard motors, one larger motor for rapid transport from place to place, and a smaller, frequently electrically powered motor for trolling at the fishing site or for other slow movement. The presence of an unused motor shaft and propeller assembly in the water creates additional drag working against movement of the boat. In shallow water or when beaching a boat, the downwardly extended propeller shaft must be considered. Frequently, sailboats are powered by auxiliary motors which, when not in use, have propeller shafts located in the water and creating additional drag.

According to the present invention, there is provided a boat and motor assembly wherein the boat motor can be a primary or secondary motive force for the boat. The motor can be of the electrically powered variety and is mounted with the motor shaft housing and propeller assembly extendible and retractible with respect to the boat hull. A housing mounted on the inside of the boat near the bow forms a compartment to store the lower shaft and propeller assembly of the motor when not in use. Lower edges of the sidewalls of the housing are in fluid sealing relationship to the floor of the boat. A compartment opening is provided centrally in the boat hull open to the compartment. Compartment doors are provided for closing the compartment opening. The motor shaft is movably mounted on a support mounted on the top wall of the housing for vertical movement so that the propeller assembly is movable from an extended position with the propeller shaft extending through the compartment opening and the propeller assembly in operative position beneath the hull of the boat, to a retracted position with the propeller assembly located in the compartment. The support can be removed from the housing so that the motor and propeller assembly can be removed as a unit from the boat. An extendible and retractible mechanism operates to selectively raise and lower the motor and propeller assembly. The compartment doors are movable between open and closed positions and are coupled to the motor shaft housing with link assemblies to move to the closed position.When the motor is raised to the retracted position, the doors swing to close the bottom of the compartment. The link assemblies limit rotational movement of the propeller assembly in the compartment. When the motor is moved toward the extended position, the doors swing open. In the closed position, the compartment doors conform substantially to the shape of the hull whereby the compartment opening does not affect the hydrodynamic performance of the boat.

The invention includes an extendible and retractible mechanism for moving an object to a desired location.

The mechanism includes a movable elongated guide bar having a groove. The bar has an elongated mouth open to the groove for accommodating a flexible push-pull cable. The cable is pressed through the mouth into the groove with a roller when the mechanism is moved from its retracted position to the extended position. The cable is confined to the groove so that the object can be moved a considerable distance by pushing the flexible cable. A cable push-pull unit connected to the flexible cable operates to longitudinally move the cable thereby move the bar and object to a desired location.

IN THE DRAWING

DESCRIPTION OF PREFERRED EMBODIMENTS

Figure 1:
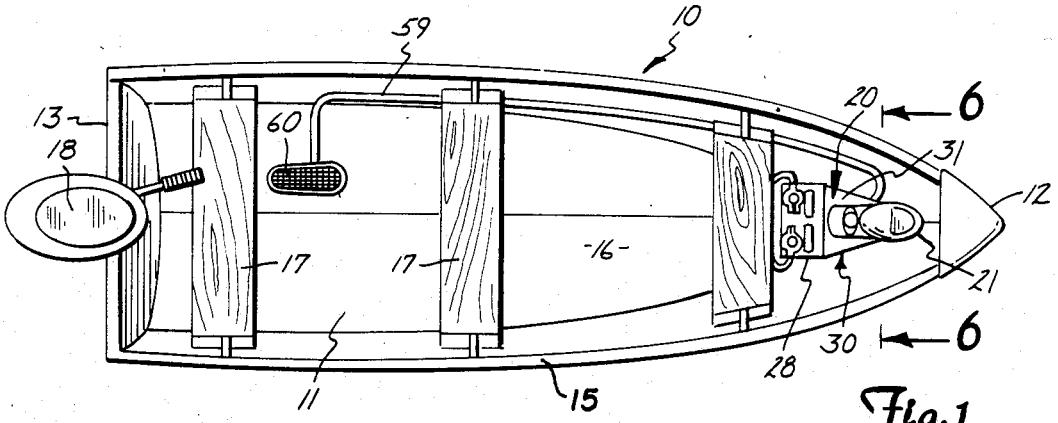
FIG. 1 is a top plan view of a boat and motor assembly according to the invention.
Figure 2:
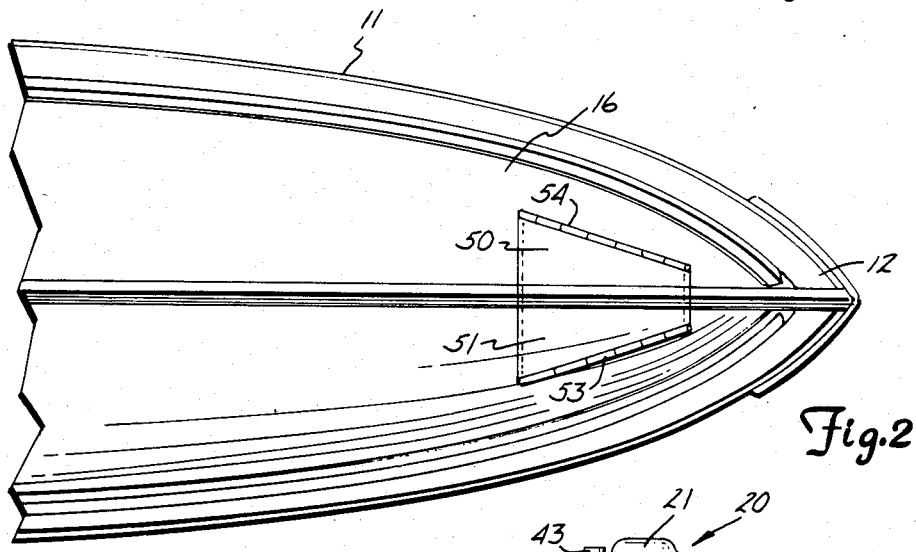
FIG. 2 is an enlarged bottom plan view of the forward portion of th boat and motor assembly of FIG. 1.

Referring to the drawing, there is shown in FIG. 1, a boat and motor assembly indicated generally at 10 comprising a boat 11 having a bow 12 and a stern defined by transverse upright transom 13. A gunnel 15 describes the upper edges of sidewalls of a boat hull 16. A plurality of transverse horizontal seats 17 extend between the sidewalls of hull 16. A conventional internal combustion outboard motor 18 mounted on transom 13 provides primary motive force for boat 11.

Figure 3:
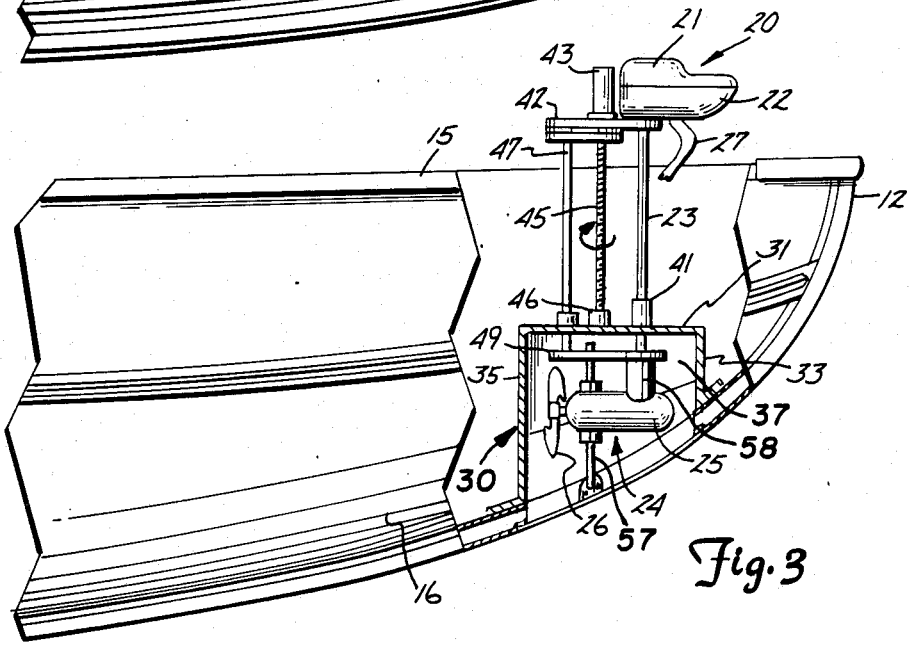
FIG. 3 is an enlarged side elevational view of the forward portion of the boat and motor assembly of FIG. 1 with portions removed for purposes of illustration.
Figure 4:
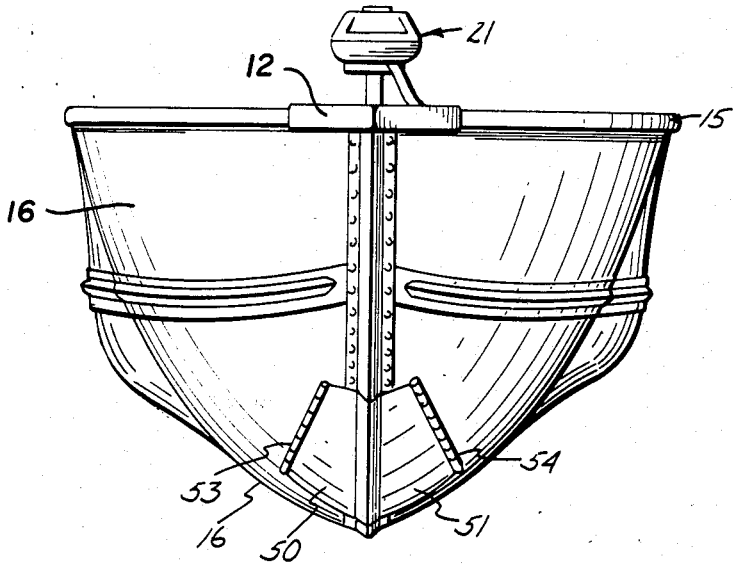
FIG. 4 is an enlarged front elevational view of the boat and motor assembly of FIG. 1.

As shown in FIG. 3, a bow motor assembly indicated generally at 20 is mounted on hull 16 toward bow 12. Motor assembly 20 includes an electrically powered outboard type motor 21 which serves as a secondary source of motive power for boat 11. Motor 21 includes a shroud 22 having various connections and controls, and a tubular shaft 23 extending downwardly from shroud 22. A propeller assembly 24 includes an electric motor 25 assembled to the lower end of shaft 23 and connected to shroud 22 by various electrical connections extending through shaft 23 (not shown). Electric motor 25 drives a screw propeller 26. Electrical cables 27 connect motor 25 to an external electrical battery 28 for powering screw propeller 26. Other propeller assemblies such as a jet pump can be driven by motor 25.

A box-like openbottom housing 30 with a trapezoidal top wall 31 and vertical sidewalls 32, 33, 34 and 35 located at bow 12 of boat 11 defines a storage or retaining compartment 37 to store motor 25 and propeller 26 when not in use. A compartment opening 38 is centrally formed in hull 16 substantially coextensive with the lower edges of sidewalls 32 to 35 of housing 30. The lower edges of sidewalls 32 to 35 are curved to conform to the interior curvature of hull 16. A lip 39 extends outward from the lower edges of sidewalls 32 to 35 and is secured in fluid tight relationship to the edges of hull 16 adjacent compartment opening 38. Suitable fastening means as bolts or the like secure lip 39 to hull 16.

Figure 7:
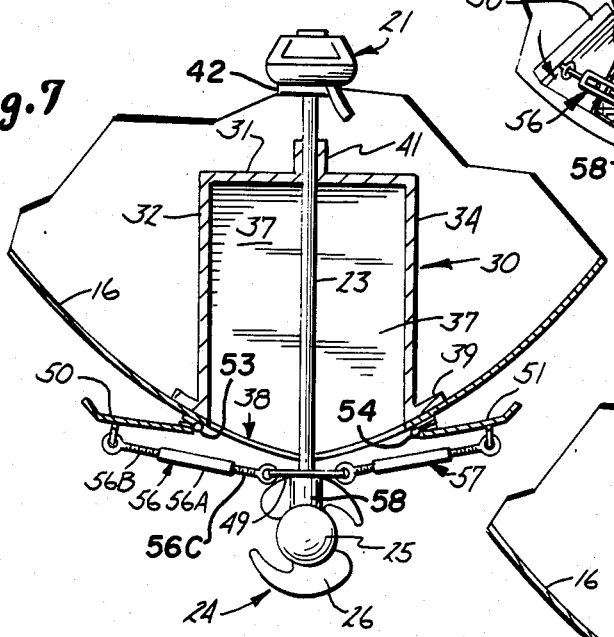
FIG. 7 is a sectional view like that of FIG. 6 showing the motor assembly in the down position with the compartment doors open.

Returning to FIG. 3, tubular collar or boss 41 extends upwardly from top wall 31 of housing 30. Shaft 23 of motor 21 is slidably assembled in collar 41 for up and down movement therein, as well as rotational movement about an upright axis. An upper mounting plate assembly 42 is pivotally assembled to the upper end of motor shaft 23. A drive mechanism for raising and lowering the motor 21 includes an electric drive motor 43 fastened to plate assembly 42 and connected to the upper end of a threaded, rotatable drive shaft 45. The lower end of drive shaft 45 engages a bearing located within a boss 46 located on the top wall 31 of housing 30. The upper end of shaft 45 is threaded through plate assembly 42. Rotation of the drive shaft 45 as when driven by the electric drive motor 43 is effective to move the uppper mounting plate assembly 42 up and down relative to the housing top wall 31 and accordingly, move electric motor 25 up and down. Electric motor 25 is movable to an up or retracted position wherein the propeller 26 is located in compartment 37 of housing 30. The outboard motor 21 is movable to a down or extended position as shown in FIG. 7 wherein motor 25 and propeller 26 is in the down position beneath hull 16 of boat 11 in operative position to be energized to move boat 11 through the water.

A guide bar 47 has an upper end also assembled to the upper mounting plate assembly 42. Guide bar 47 extends through a suitable guide opening provided in top wall 31 of housing 30 and has a lower end connected to a lower mounting plate assembly 49. Lower plate assembly 49 has a hole accommodating shaft 23 whereby motor 25 and propeller 26 can be rotated about a vertical axis. An upwardly extended sleeve 58 secured to motor 25 bears against plate assembly 49 for purposes of stability of the bow motor assembly.

Closure means are provided to close compartment opening 38 when motor 25 and propeller 26 are in the up or retracted position. A pair of symmetrical compartment doors 50 and 51 are connected by elongate hinges 53 and 54 to the edges of hull 16 adjacent the sides of compartment opening 38. Doors 50 and 51 are shaped to conform generally to the shape of hull 16 when in the closed position and have adjacent edges that come together generally in alignment with the keel of hull 16.

Figure 5:
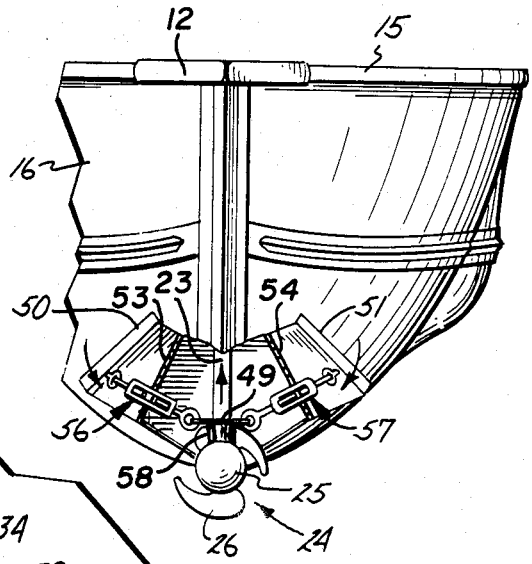
FIG. 5 is a fragmentary front elevational view of the boat and motor assembly of FIG. 4 with the motor assembly in the down position.
Figure 6:
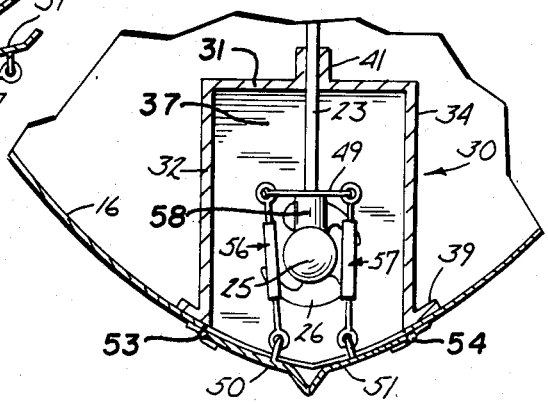
FIG. 6 is an enlarged sectional view of a portion of the boat and motor assembly of FIG. 1 taken along the line 6-6 thereof showing the motor assembly in the up position.

Compartment doors 50 and 51 are linked to plate assembly 49 for opening and closing as motor 25 is extended and retracted. As shown in FIGS. 6 and 7, a first link assembly 56 is pivotally connected at one end to the interior surface of first door 50, and pivotally connected at the opposite end to plate assembly 49. A second link assembly 57 is pivotally connected at one end to the interior surface of second door 51 and at the opposite end to plate assembly 49. Upon raising of motor 25, link assemblies 56 and 57 pull compartment doors 50 and 51 up to the closed position as shown in FIGS. 2, 3, 4, and 6. Upon lowering of the motor 25, links 56 and 57 push compartment doors 50 and 51 to open positions of FIGS. 5 and 7. As shown in FIG. 7, link assembly 56 is a turnbuckle assembly having a turnbuckle yoke 56A and threaded, outwardly extended turnbuckle arms 56B and 56C threadably connected to opposite ends of yoke 56A. Link 57 has the same structure as link 56 and 56C. Other types of rigid links can be used in lieu of link assemblies 56 and 57. Yoke 56A is used to adjust the length of link assembly 56. This adjustment is used to keep doors 50 and 51 in tight closed positions.

In operation, drive motor 43 is used to lower outboard motor 21 to an operative position relative to hull 16 of boat 11. As the motor is lowered, the compartment doors 50 and 51 are swung open by the links 56 and 57. Electric motor 25 can then be operated by remote control assembly 59 having a foot pedal 60 to control speed and direction as is known in the art. The boat operator can then troll or otherwise proceed slowly through the water. Upon completion, drive motor 43 is operated to lift outboard motor 21 to the point where the lower shaft portion 23, electric motor 25 and screw propeller 26 are stored in compartment 37. At the same time that the shaft 23 is retracted, the links 56 and 57 swing the compartment doors 50 and 51 to the closed position. Link assemblies 56 and 57, as shown in FIG. 6, located on opposite sides of electric motor 25 hold doors 50 and 51 in their closed positions. The link assemblies 56 and 57 also restrain electric motor 25 and propeller 26 from rotating about the vertical axis so that the propeller 26 does not strike housing walls 32 and 34 when in the up position. Primary motive source 18 is then operated to move the boat through the water.

Figure 8:
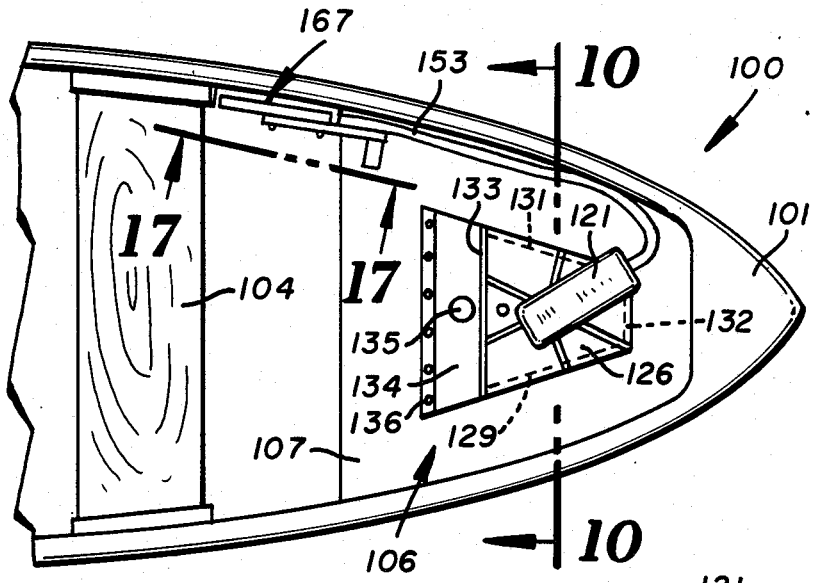
FIG. 8 is a plan view of the bow portion of a boat equipped with a modification of the bow motor assembly of the invention.
Figure 9:
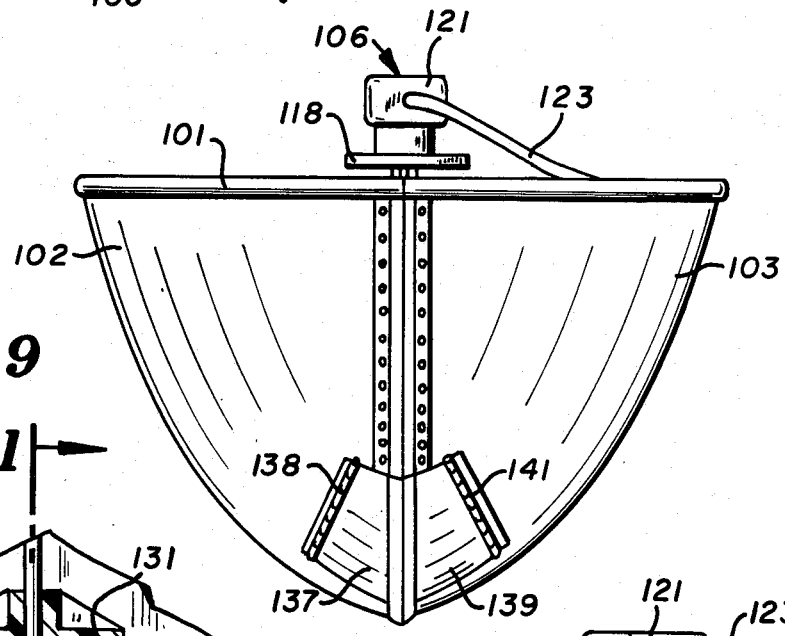
FIG. 9 is an enlarged front view of FIG. 8.
Figure 10:
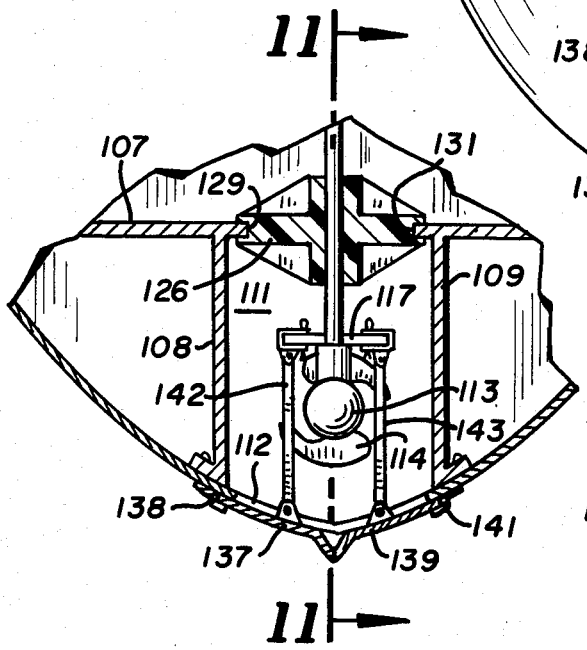
FIG. 10 is an enlarged sectional view taken along the line 10—10 of FIG. 8 showing the compartment doors in a closed position.
Figure 11:
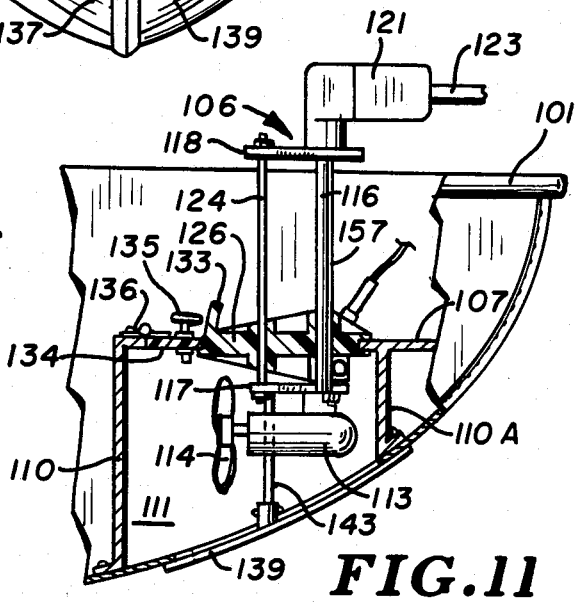
FIG. 11 is a sectional view taken along the line 11—11 of FIG. 10.

Referring to FIGS. 8 and 9, there is shown a boat indicated generally at 100 having a box 101 and side walls 102 and 103. A plurality of transverse seats 104 extend between side walls 102 and 103. A bow motor assembly indicated generally at 106 is located in the bow portion of boat 100. Bow motor assembly 106 is movably mounted on a generally horizontal platform 107 located in the bow of the boat. Downwardly directed side walls 108 and 109 and end walls 110 and 110A shown in FIGS. 10 and 11 are attached to platform 107 and the bottom of the boat to form a compartment 111. The bottom of the compartment 111 is open at 112 to allow a motor 113 to be lowered into the water below the bow of the boat. Motor 113 is an electric motor that drives a screw propeller 114. Other types of motors can be used to drive propeller 114. Motor 113 and propeller 114 can be replaced with a jet pump used to propel boat 110.

Figure 14:
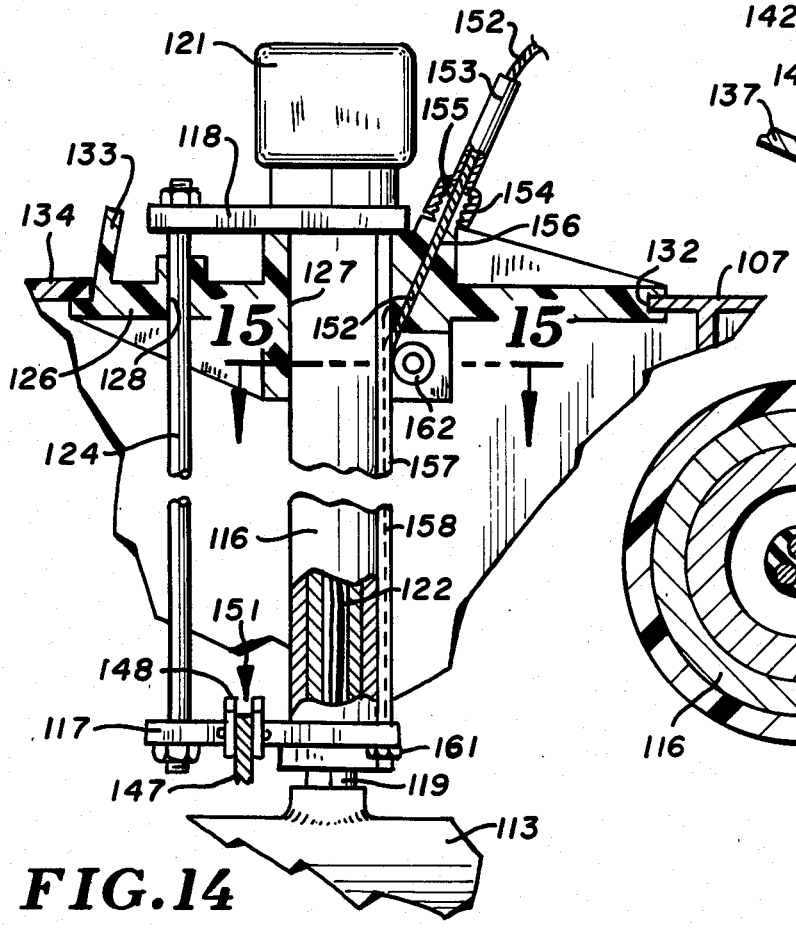
FIG. 14 is an enlarged foreshortened sectional view of FIG. 13.

As shown in FIG. 14, a first upright tube 116 is secured at its lower end to a horizontal lower plate 117 and at its upper end to a upper plate 118. A second tube 119 rotatably mounted within first tube 116 is attached at its lower end to motor 113. The upper end of tube 119 is operatively connected to a motor controller 121. Controller 121 is operable to rotate the tube 119 and thereby change the circumferential angle of motor 113 to facilitate the steering of boat 100. Controller 121 has a reversible electric steering motor (not shown) drivably connected to tube 119 to rotate the tube 119. Operator controls are used to control the reversible electric storing motor and the speed of the motor 113. An electrical cable 122 extends downwardly through tube 119 to provide an electrical connection to the motor 113 and a battery (not shown). An external cable 123 connects controller 121 to the battery and switches to control the speed of the motor 113.

Figure 13:
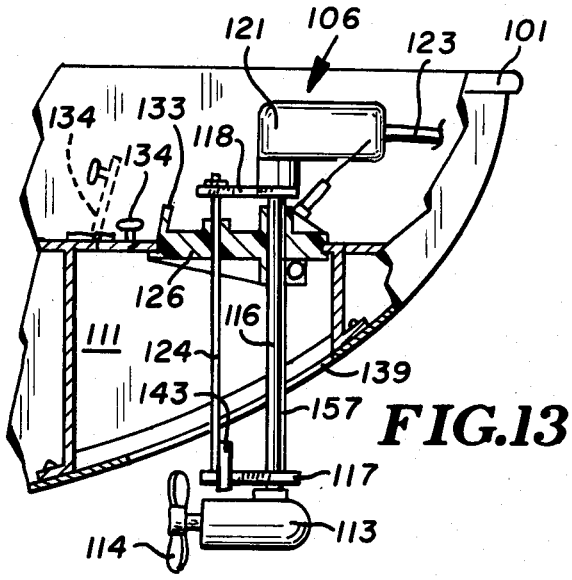
FIG. 13 is a sectional view taken along the line 13—13 of FIG. 12.

An upright rod 124 extended generally parallel to tube 116 is attached to plates 117 and 118 to insure linear nonrotative movement of tube 116 and stabilize motor 113 and propeller 114. Tube 116 and rod 124 are slidably mounted in a support 126. Support 126 has a first upright hole 127 slidably accommodating the tube 116 and a second hole 128 slidably accommodating the rod 124. Support 126 has side grooves 129 and 131 and a front groove 132 that fit into the side and front edges of the platform 107 in a tongue and groove arrangement. Support 126 has a generally trapazoidal shape, as shown in FIG. 8, with forwardly converging side grooves 129 and 131 and a transverse front groove 132. The support 126 fits into a generally trapazoidal opening in the center of platform 107. The opening has a length longer than support 126 to allow support 126 to be moved backward and lifted from the platform 107. As shown in FIG. 14, support 126 has an upwardly inclined rear lip 133 that engages a flexible flap 134, such as a flexible rubber or plastic sheet member. Flap 134 holds support 126 in its forward mounted position on platform 107. A knob 135 is secured to the center of flap 134 to facilitate the lifting of the flap from support 126. A fastener 136, such as a bar and bolts, are used to attach the rear edge of flap 134 to platform 107. As shown in FIG. 13, flap 134 can be flexed to an up position to release support 126. The suppport 126 can be moved in a rearward direction to release the platform from the support. The motor assembly 106 can be lifted from platform 107.

Figure 12:
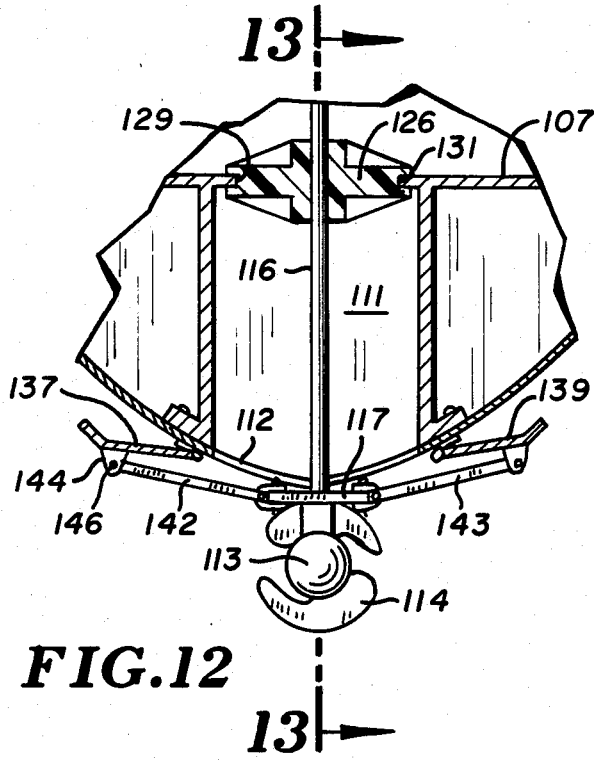
FIG. 12 is a sectional view similar to FIG. 10 showing the electric motor and propeller in the down position with the compartment doors open.

As shown in FIGS. 9 and 10, a pair of doors 137 and 139 are hinged to the boat 100 with hinges 138 and 141. Doors 137 and 139 conform to the curvature of the hull of boat 100 and close the opening 112. Doors 137 and 138 can be swung to outwardly open positions, as shown in FIG. 12, to open the bottom of compartment 112. Doors 137 and 139 automatically move to their open positions when the motor 113 and propeller 114 are moved to the down position below the bottom of the boat.

Figure 16:
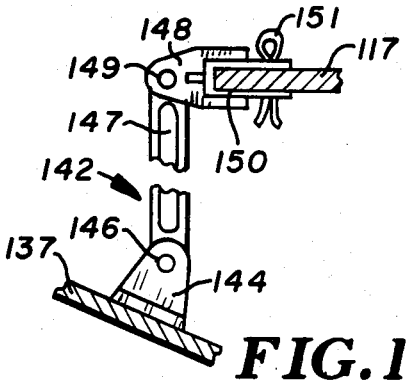
FIG. 16 is an enlarged foreshortened side view of a link assembly for holding door closed and moving the door to an open position.

A pair of link assemblies 142 and 143 pivotally connect plate 117 to doors 137 and 139. Link assemblies 142 and 143 are identical in structure. The following description is directed to link assembly 142. As shown in FIG. 16, link assembly 142 is connected to a yoke 144 with a pivot member 146. Yoke 144 is secured to door 137. A strut 147 having a gererally spherical end is located between the yoke 144 and accommodates the pivot members 146, such as a nut and bolt assembly. The upper end of the strut 147 is joined to a U-shaped connector 148 with a pivot member 149, such as a nut and bolt assembly. A generally spherical member of ball joined to the upper end of strut 147 is located between the sides of U-shaped connector 148. Connector 148 has a slot 150 accommodating plate 117. A releasable pin 151 joins connector 148 to plate 117. Pin 151 can be removed from connector 148 and plate 117 to allow the motor assemby 106 to be withdrawn from compartment III.

Figure 15:
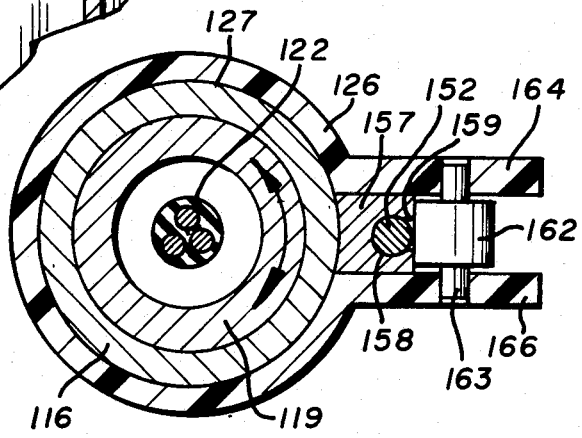
FIG. 15 is an enlarged sectional view taken along the line 15—15 of FIG. 14.

An extendible and contractible mechanism is used to raise and lower the motor assembly 106 into and out of compartment 111. The mechanism comprises as elongated flexible cable 152 located in a tubular jacket or sheath 153. Jacket 153, as shown in FIG. 14, accommodates a fastener such as a nut 154 that is threaded onto a projection 155 on the top of support 126. Cable 152 passes through a passage 156 in the support to a upright guide bar 157 secured to the side of tube 116. Guide bar 157 has an upright groove 158 accommodating cable 152. As shown in FIG. 15, groove 158 has a generally circular configuration with an opening or mouth 159 that is smaller than the major diameter of the groove. Mouth 159 is also smaller than the diameter of the cable 152 so that the cable must be pressed into groove 158. The lower end of cable 152 is attached with a fastener 161 to plate 117.

A roller 162, shown in FIGS. 14 and 15, is rotatably mounted on an axle 163 secured to a pair of ears 164 and 166. The ears 164 and 166 are integral with the bottom of support 126 and are located adjacent guide bar 157. Roller 162 engages the front face of guide bar 157 and forces cable 152 through mouth 159 into groove 158 when the motor assembly is lowered to its down position. The cable 152 is confined to groove 158 by the lips of the mouth 159. The inside wall of bar 157 forming groove 158 holds the cable 152 in a substantially straight position so that its pushing force can be used over an extended length. The cable 152 will not bend or kink when a longitudinal force is applied thereto. Cable 152 is pulled to raise the motor and propeller assembly back into the compartment. When the cable 152 is pulled, it is extracted from groove 158 as it rolls over roller 162 and moves up passage 156. The motor 113 and propeller 114 are moved up into compartment 111. A releasable lock (not shown) is used to hold the motor assembly 106 in the raised position.

The extendible and contractible mechanism is used to move an object, such as the motor 113 and propeller 114 to a selected location. The type of object or member that is moved can vary in size, shape and utility. The mechanism has a support slidably accommodating tube 116. Tube 116 is a first means that is movably mounted on the support 126 for movement between first and second positions. Plates 117 and 118 are attached to opposite ends of the tube 116 and an upright guide bar 124. The guide bar 124 is slidably mounted on support 126. An elongated guide bar 157 is secured to the side of tube 116. Bar 157 has an elongated groove 158 and an elongated mouth 159 open to the groove 158. An elongated flexible member 152, shown as a cable, having a width greater than the width of the mouth 159 is adapted to be pressed into groove 158. This is achieved with roller 162 when the cable 152 is pushed down toward groove 158 to lower motor assembly 106. Roller 162 located adjacent the upper end of mouth 159 engages the cable 152 as it moves into groove 158. When cable 152 is pulled with push-pull unit 167, it is extracted from groove 158 as it moves over roller 162. This mechanism allows an elongated generally flexible member to be used to move the tube 116 and object connected thereto a substantial distance without bending or kinking the flexible member.

Figure 17:
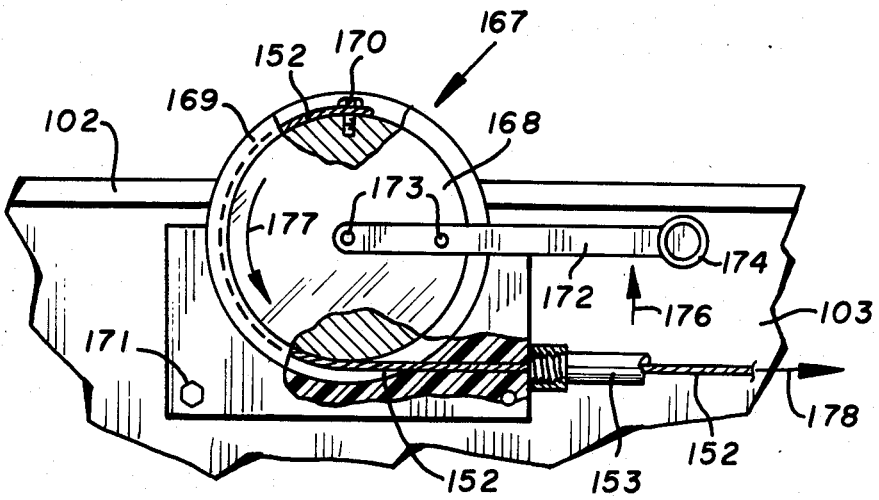
FIG. 17 is an elevational view taken along the line 17—17 of FIG. 8.

Referring to FIG. 17, a cable push-pull unit indicated generally at 167, is used to push and pull cable 152 and thereby selectively raise and lower the motor assembly 106 into and out of compartment 111. Unit 167 has a rotatable disc or reel 168 mounted in a housing 169. Housing 169 is secured to bolts 171 or the like to the side wall 103 of the boat. An elongated handle 172 is attached with bolts 173 to reel 169. The outer end of handle 172 has a hand grip 174 to facilitate the rotation of reel 168. The cable 152 wraps around reel 168 and is secured thereto with a bolt 170. When the handle 172 is moved in an upward direction as indicated by the arrow 176 the reel 168 is rotated as shown by the arrow 177. This moves cable 152 in a forward direction as indicated by the arrow 178. The cable 152 forces the tube 116 downwardly through the support 126 to lower the motor 113 and propeller 114 mounted thereon through the opening 112 in the bottom of the boat. The doors 137 and 139 automatically swing open. The struts 142 and 143 swing the doors 137 and 139 to the open position as shown in FIG. 12. When the handle 172 is moved in an opposite or clockwise direction as shown in FIG. 17, the cable 152 is pulled onto reel 168. This moves tube 116 in an upward direction retracting the motor and propeller 114 up into compartment 111. Doors 137 and 139 fold to their closed positions as shown in FIG. 10. The link assemblies 142 and 143 are located on opposite sides of the motor 113. They function as stops to prevent the inadvertant rotation of the motor in the compartment 111 to minimize the engagement of propeller 114 with the side walls 108 and 109 defining compartment 111.

Modifications and variations of the structure of the housing, compartment doors, secondary boat propulsion device and linkage operably connecting the propulsion device to the doors and cable lift mechanism may be made by one skilled in in the art without departing from the scope of the present invention. It is understood that the invention may be practiced otherwise than as specifically described.

The embodiments of the invention in which an exclusive property or privilege is claimed are defined as follows:

1. A boat and motor assembly comprising: a boat having a hull with a bottom opening therein, a housing mounted on the hull, said housing having a compartment aligned with the bottom opening, a motor, propeller means drivably connected to the motor whereby on operation of the motor the propeller means drives the boat, a support mounted on the housing, said support and housing having cooperating means releasably mounting the support on the housing whereby the motor and propeller means can be removed from the boat, means movably mounting the motor on the support whereby the motor and propeller means can be located in the compartment or below the hull, extendible and contractible means for selectively raising and lowering the motor between a first position wherein the motor and propeller means is located in the compartment and a second position wherein the motor and propeller means are located below the hull, said extendible and contractible means including an elongated bar secured to the means movably mounting the motor on the support, said bar having an elongated groove along the length thereof and an elongated mouth open to the groove, an elongated cable having a size to be pressed into the groove, roller means located adjacent the mouth for pressing the cable into the groove when the cable is pushed, said cable being extracted from the groove when the cable is pulled, and means for selectively pushing and pulling the cable to move the motor out of and into the compartment.

2. The boat and motor assembly of claim 1 wherein: said housing has a top wall, said wall having a trapazoidal-shaped opening, said support having a trapazoidal shape smaller than said trapazoidal shaped opening, said top wall and support having cooperating means that hold the support on the top wall, and holding means to retain the support in engagement with the top wall, said holding means being operable to release the support whereby the support can be removed from the housing.

3. The boat and motor assembly of claim 2 wherein: said cooperating means comprise grooves in the support and edges of the top wall located in said grooves.

4. The boat and motor assembly of claim 2 wherein: said support has a transverse edge and side edges diverging from the transverse edge, said cooperating means comprise grooves in said transverse and side edges and edges of the top wall located in said grooves.

5. The boat and motor assembly of claim 1 wherein: the means movably mounting the motor on the support is an upright cylindrical member slidably mounted on the support, and said bar comprises a linear bar secured to the cylindrical member.

6. The boat and motor assembly of claim 1 including: means rotatably mounting the roller means on the support adjacent an end of the groove.

7. The boat and motor assembly of claim 1 wherein: the groove has a generally circular cross section, said mouth having a width smaller than the diameter of the groove.

8. The boat and motor assembly of claim 1 including: guide rod means movably mounted on the support for movement generally parallel to the means movably mounting the motor to the support, and means connecting the guide rod means to the means movably mounting the motor to the support.

9. The boat and motor assembly of claim 8 wherein: the means connecting the guide rod means to the means movably mounting the motor to the support comprises plates connected to opposite portions of the means mounting the motor to the support.

10. The boat and motor assembly of claim 9 wherein: the means movably mounting the motor to the support comprises an upright tubular member slidably mounted on the support.

11. The boat and motor assembly of claim 1 including: cover means attached to the hull movable between a closed position in covering relationship to the compartment opening, and an open position in clearing relationship to the compartment opening, and means interconnecting the motor and the cover means whereby when the motor is moved to the second position below the hull, the cover means is moved to the open position, and when the motor is moved to the first position, the cover means is moved to the closed position.

12. The boat and motor assembly of claim 11 wherein: said cover means includes a first cover and a second cover each pivotally connected to the hull on the outside thereof adjacent a hull edge adjacent said compartment opening, said first and second covers movable toward one another to the closed position and movable away from one another to the open position.

13. The boat and motor assembly of claim 12 wherein: the means interconnecting the motor and the cover means includes a plate mounted on the motor, a first link pivotally connected at one end to the plate and at the opposite end to the first cover, and a second link pivotally connected at one end to the plate and at the other end to the second cover whereby movement of the motor toward the first position pulls the first and second covers to the closed position and movement of the motor toward the second position pushes the first and second covers toward the open position.

14. A boat and motor assembly comprising: a boat having a hull with a compartment opening in the bottom thereof; a boat motor of the type having a motor support means and a propeller assembly at the lower end of the motor support means; a housing located on said hull and defining a retaining compartment, said compartment opening of the hull being open to the retaining compartment of the housing; means mounting the boat motor on the housing with the motor support means extending into the compartment; extendible and contractible means to raise and lower the motor support means between a first up position with the propeller assembly located in the compartment and a second down position with a portion of the motor support means extended through the compartment opening and with the propeller assembly located beneath the hull in position to provide motive force to the boat; said extendible and contractible means comprising a bar secured to the motor support means, said bar having an elongated groove along the length thereof and an elongated mouth open to the groove, an elongated flexible member having a size to be pressed into the groove, roller means located adjacent the mouth for pressing the cable into the groove when the flexible member is pushed, said flexible member being extracted from the groove when the flexible member is pulled, and means for selectively pushing and pulling the flexible means to move the propeller assembly out of and into the compartment.

15. The boat and motor assembly of claim 14 including: cover means attached to the hull movable between a closed position in covering relationship to the compartment opening, and an open position in clearing relationship to the compartment opening; said cover means including a first cover having a first edge and a second edge and a second cover having a first edge and a second edge, first means pivotally connecting the first edge of the first cover to said hull adjacent one side of the opening therein for movement between open and closed positions, second means pivotally connecting the first edge of the second cover to said hull adjacent the side opposite said one side of the opening therein for movement between open and closed positions, said second edges of the first and second covers being engageable with each other when they are in said closed positions, means interconnecting the boat motor and the first and second covers whereby when the motor support means and propeller assembly are moved to the second position, the first and second covers pivot to the open positions, and when the motor support means and propeller assembly are moved to the first position, the first and second covers pivot to the closed positions, said means interconnecting the boat motor and the cover means including a first link pivotally connected at one end thereof to the motor and at the opposite end to the first cover adjacent the second edge of the first cover, and a second link pivotally connected at one end thereof to the motor and at the opposite end to the second cover adjacent the second edge of the second cover whereby movement of the motor in a downward direction pivots the first and second covers to the open positions and movement of the motor in an upward direction pivots the first and second covers from the open positions to the closed positions locating the propeller assembly in the compartment, said first and second links being located in generally upright positions adjacent opposite sides of the propeller assembly when the first and second covers are in the closed positions to hold said first and second covers in said closed positions.

16. The boat and motor assembly of claim 15 including: plate means mounted on the motor support means above the propeller assembly, said one end of the first link being pivotally connected to said plate means, and said one end of the second link being pivotally connected to said plate means.

17. The boat and motor assembly of claim 14 wherein: the means mounting the boat motor on the housing includes a support mounted on the housing.

18. The boat and motor assembly of claim 17 wherein: said housing has a top wall having a trapazoidal shaped opening, said support having a trapazoidal shape smaller than said trapazoidal shaped opening, said top wall and support having cooperating means that hold the support on the top wall, and holding means to retain the support in engagement with the top wall, said holding means being operable to release the support whereby the support can be removed from the housing.

19. The boat and motor assembly of claim 18 wherein: said support has a transverse edge and side edges diverging from the transverse edge, said cooperating means comprises grooves in said transverse edge and side edges and edges of the top wall located in said grooves.

20. Apparatus for mounting a boat motor of the type having a shaft and a propeller assembly at the end of the shaft, on a boat having a hull, for raising and lowering the boat motor relative to the boat, comprising: a housing mounted on the bottom of the hull on the interior surface thereof and defining a compartment, said hull having a compartment opening open to the compartment of the housing, means including a support and a member mounted for movement relative to the support mounting the motor on the housing with the propeller assembly and motor extended into the compartment, said support and housing having cooperating means for holding the support on the housing, said support being releasable from the housing to allow the motor and propeller assembly to be removed from the housing, extendible and contractible means to selectively raise and lower the motor and propeller assembly between a first up position with the motor and propeller assembly located in the compartment and a second down position with the motor and the propeller assembly located beneath the hull in position to provide motive force to the boat, the extendible and contractible means including an elongated bar secured to the member movably mounting the motor on the support, said bar having an elongated groove along the length thereof and an elongated mouth open to the groove, an elongated cable having a size to be pressed into the groove, roller means located adjacent the mouth for pressing the cable into the groove when the cable is pushed, said cable being extracted from the groove when the cable is pulled, and means for selectively pushing and pulling the cable to move the motor out of and into the compartment; cover means is pivotally connected to the hull for pivotal movement between a closed position in covering relationship to the compartment opening, and an open position in clearing relationship to the compartment opening, plate means mounted on the member above the motor, link means connected to the plate means and cover means, means pivotally connecting the link means to the cover means remote from the pivotal connection of the cover means to the hull whereby when the motor and propeller assembly are moved from the closed position to the open position, and the link means is located in an upright position adjacent the motor.

21. The apparatus of claim 20 wherein: said cover means includes a first cover and a second cover each pivotally connected to the hull on the outside thereof adjacent a hull edge adjacent said compartment opening, said first and second covers movable toward one another to the closed position, said first and second covers being contoured to generally conform to the shape of the hull when in the closed position, and movable away from one another to the open position.

22. The apparatus of claim 21 whewrein: the link means includes a first link pivotally connected at one end to the first cover and connectible at the other end to the plate means, and a second link pivotally connected at one end to the second cover and pivotally connectible at the opposite end to the plate means whereby movement of the motor towards the first position when connected to the first and second links pulls the first and second covers to the closed position and movement of the motor toward the second position pushes the first and second covers toward the open position.

23. The apparatus of claim 20 wherein: said housing has a top wall having a trapazoidal shaped opening, said support having a trapazoidal shape smaller than said trapazoidal shaped opening, said cooperating means comprising grooves in outer edges of the support and edged portions of the housing located in said grooves, and holding means to retain the support in engagement with the top wall, said holding means being operable to release the support whereby the support and motor can be removed from the housing.

24. The apparatus of claim 23 wherein: said support has a transverse edge and side edges diverging from the transverse edge, said cooperating means comprise grooves in said transverse and side edges and edges of the top wall located in said grooves.

25. The apparatus of claim 20 wherein: the member movably mounting the motor on the support is an upright cylindrical member slidably mounted on the support, and said bar comprises a linear bar secured to the cylindrical member.

26. The apparatus of claim 20 including: means rotatably mounting the roller means on the support adjacent an end of the groove.

27. The apparatus of claim 20 wherein: the groove has a generally circular cross section, said mouth having a width smaller than the diameter of the groove.

28. The apparatus of claim 20 including: guide rod means movably mounted on the support for movement generally parallel to the member movably mounting the motor to the support, and means connecting the guide rod means to the member movably mounting the motor to the support.

29. The apparatus of claim 28 wherein: the means connecting the guide rod means to the member movably mounting the motor to the support comprises plates connected to opposite portions of the member mounting the motor to the support.

30. An extendible and contractible mechanism for moving an object to a selected location comprising: a support, first means movably mounted on the support for movement between first and second positions, said first means being connectible to the object, an elongated bar secured to the first means whereby the first means and bar move together relative to the support, said bar having an elongated groove along the length thereof and an elongated mouth open to the groove, said mouth having a width smaller than the width of said groove, an elongated cable having a width greater than the width of the mouth adapted to the pressed into said groove, roller means located adjacent the mouth for pressing the cable into the groove when the cable is pushed, said cable being extracted from the groove when the cable is pulled, and second means for selectively pushing and pulling the cable to move the first means between said first and second positions.

31. The mechanism of claim 30 wherein: the first means movably mounted on the support comprises an elongated cylindrical member, and said bar comprising a linear bar secured to the cylindrical member.

32. The mechanism of claim 30 including: means rotatably mounting the roller means on the support adjacent an end of the groove.

33. The mechanism of claim 30 wherein: the groove has a generally circular cross section.

34. The mechanism of claim 30 wherein: said support has means slidably accommodating the first means for movement between the first and second positions.

35. The mechanism of claim 30 including: guide rod means movably mounted on the support for movement generally parallel to the first means, and means connecting the guide rod means to the first means.

36. The mechanism of claim 35 wherein: the means connecting the guide rod means to the first means comprise plates connected to opposite portions of the first means.

37. An extendible and contractible mechanism for moving an object to a selected location comprising: a support, first means movably mounted on the support for movement between first and second positions, said first means being connected to the object, and elongated means secured to the first means whereby the first means and elongated means move together relative to the support, said elongated means having an elongated groove and an elongated mouth open to the groove, said mouth having a width smaller than the width of the groove, elongated flexible means having a width greater than the width of the mouth adapted to be pressed into the groove, roller means located adjacent the mouth for pressing the flexible means into the groove when the flexible means is pushed, said flexible means being extracted from the groove when the flexible means is pulled, and second means for selectively pushing and pulling the flexible means to move the first means between said first and second positions.

38. The mechanism of claim 37 wherein: the first means comprises an elongated cylindrical member, and said elongated means comprises a linear bar secured to the cylindrical member.

39. The mechanism of claim 37 including: means rotatably mounting the roller means on the support adjacent one end of the groove.

40. The mechanism of claim 37 wherein: the groove has a generally circular cross section.

41. The mechanism of claim 37 wherein: said support has means slidably accommodating the first means for movement between the first and second positions.

42. The mechanism of claim 37 including: a guide rod means movably mounted on support for movement generally parallel to the first means, and means connecting the guide rod means to the first means.

43. The mechanism of claim 42 wherein: the means connecting the guide rod means to the first means comprises plates connected to the opposite ends of the first means.

* * * * *

UNITED STATES PATENT AND TRADEMARK OFFICE

CERTIFICATE OF CORRECTION

PATENT NO. : 4,668,195

DATED : May 26, 1987

INVENTOR(S) : David N. Smith

It is certified that error appears in the above-identified patent and that said Letters Patent is hereby corrected as shown below:

Column 2, line 18, "th" should be --the--.

Column 4, line 54, "box" should be --bow--.

Column 5, line 66, "gererally" should be --generally--.

Column 6, line 10, "III" should be --111--.

Column 11, line 26, "whewrein" should be --wherein--.

Signed and Sealed this

Twenty-fourth Day of November, 1987

*Attest:*

DONALD J. QUIGG

*Attesting Officer*

*Commissioner of Patents and Trademarks*